US011725265B2

(12) United States Patent
Bonnet et al.

(10) Patent No.: US 11,725,265 B2
(45) Date of Patent: Aug. 15, 2023

(54) HIGH FORMABILITY STEEL SHEET FOR THE MANUFACTURE OF LIGHTWEIGHT STRUCTURAL PARTS AND MANUFACTURING PROCESS

(71) Applicant: ArcelorMittal, Luxembourg (LU)

(72) Inventors: Frédéric Bonnet, Avril (FR); Manuel Bobadilla, Saulny (FR); Bertrand Bele, Metz (FR); Valérie Daeschler, Roncourt (FR)

(73) Assignee: ARCELORMITTAL, Luxembourg (LU)

( * ) Notice: Subject to any disclaimer, the term of this patent is extended or adjusted under 35 U.S.C. 154(b) by 0 days.

(21) Appl. No.: 17/751,615

(22) Filed: May 23, 2022

(65) Prior Publication Data

US 2022/0282360 A1 Sep. 8, 2022

Related U.S. Application Data

(62) Division of application No. 16/605,690, filed as application No. PCT/IB2018/052748 on Apr. 20, 2018, now Pat. No. 11,427,898.

(30) Foreign Application Priority Data

Apr. 21, 2017 (WO) ..... PCT/IB2017/05231

(51) Int. Cl.
*C22C 38/14* (2006.01)
*C21D 8/02* (2006.01)
(Continued)

(52) U.S. Cl.
CPC ..... *C22C 38/14* (2013.01); *C21D 8/0215* (2013.01); *C21D 8/0226* (2013.01);
(Continued)

(58) Field of Classification Search
None
See application file for complete search history.

(56) References Cited

U.S. PATENT DOCUMENTS

2013/0174942 A1 7/2013 Bonnet et al.
2015/0147589 A1 5/2015 Bouaziz et al.
(Continued)

FOREIGN PATENT DOCUMENTS

CN 101563476 B 11/2011
CN 105838993 A 8/2016
(Continued)

*Primary Examiner* — Anthony M Liang
(74) *Attorney, Agent, or Firm* — Davidson, Davidson & Kappel, LLC

(57) ABSTRACT

A steel sheet has a composition comprising, by weight: 0.010%≤C≤0.080%, 0.06%≤Mn≤3%, Si≤1.5%, 0.005%≤Al≤1.5%, S≤0.030%, P≤0.040%, Ti and B such that: 3.2%≤Ti≤7.5% and (0.45×Ti)−1.35≤B≤(0.45×Ti)−0.43, optionally Ni≤1%, Mo≤1%, Cr≤3%, Nb≤0.1%, V≤0.1%, the remainder being iron and unavoidable impurities resulting from the smelting. The steel sheet has a structure consisting of ferrite, at most 10% of austenite, and precipitates comprising eutectic precipitates of $TiB_2$, the volume fraction of $TiB_2$ precipitates with respect to the whole structure being of at least 9%, the proportion of $TiB_2$ precipitates having a surface area lower than 8 $\mu m^2$ being of at least 96%.

22 Claims, 5 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/32*** | (2006.01) |

(52) U.S. Cl.

CPC ..... *C21D 8/0236* (2013.01); *C22C 38/02* (2013.01); *C22C 38/04* (2013.01); *C22C 38/06* (2013.01); *C22C 38/08* (2013.01); *C22C 38/12* (2013.01); *C22C 38/32* (2013.01); *C21D 2211/001* (2013.01); *C21D 2211/004* (2013.01); *C21D 2211/005* (2013.01)

(56) References Cited

U.S. PATENT DOCUMENTS

| | | | |
|---|---|---|---|
| 2015/0247223 | A1 | 9/2015 | Liu et al. |
| 2019/0144965 | A1 | 5/2019 | Yang et al. |

FOREIGN PATENT DOCUMENTS

| | | | |
|---|---|---|---|
| EP | 1897963 | A1 | 3/2008 |
| EP | 2703510 | A1 | 3/2014 |
| JP | 2002105588 | A | 4/2002 |
| JP | 2004035948 | A | 2/2004 |
| JP | 2004218069 | A | 8/2004 |
| JP | 2005154826 | A | 6/2005 |
| JP | 2013129910 | A | 7/2013 |
| JP | 2015534605 | A | 12/2015 |
| KR | 1020090043555 | A | 5/2009 |
| RU | 2578280 | C2 | 3/2016 |
| WO | WO2017173950 | A1 | 10/2017 |

HIGH FORMABILITY STEEL SHEET FOR THE MANUFACTURE OF LIGHTWEIGHT STRUCTURAL PARTS AND MANUFACTURING PROCESS

This is a divisional of U.S. application Ser. No. 16/605,690 which has a filing date of Oct. 16, 2019 and which is a national stage of PCT/IB2018/052748 filed Apr. 20, 2018 which claims priority to PCT/IB2017/052312 filed Apr. 21, 2017, the entire disclosures of which are hereby incorporated by reference herein.

The present disclosure relates to the manufacture of steel sheets or structural parts combining a high elasticity modulus E in tension, a low density d and a high processability, especially a high castability and high formability and ductility.

BACKGROUND

The mechanical performance in stiffness of structural elements are known to vary as $E^x/d$, the coefficient x depending on the mode of external loading (for example in tension or in bending) and on the geometry of the elements (plates, bars). Thus, steels exhibiting both a high elasticity modulus and a low density have high mechanical performances.

This requirement applies most particularly in the automotive industry, where vehicle lightening and safety are constant preoccupations. In order to produce steel parts having increased elasticity modulus and reduced density, it was proposed to incorporate in the steel ceramic particles of various types, such as carbides, nitrides, oxides or borides. Such materials indeed have a higher elasticity modulus, ranging from about 250 to 550 GPa, than that of base steels, which is around 210 GPa, into which they are incorporated. Hardening is achieved by load transfer between the steel matrix and the ceramic particles under the influence of a stress. This hardening is further increased due to the matrix grain size refinement by the ceramic particles. To manufacture these materials comprising ceramic particles distributed uniformly in a steel matrix, processes are known that are based on powder metallurgy: firstly, ceramic powders of controlled geometry are produced, these being blended with steel powders, thereby corresponding, for the steel, to an extrinsic addition of ceramic particles. The powder blend is compacted in a mold and then heated to a temperature such that this blend undergoes sintering. In a variant of the process, metal powders are blended so as to create the ceramic particles during the sintering phase.

This type of process however suffers from several limitations. Especially, it requires careful smelting and processing conditions in order not to cause a reaction with the atmosphere, taking into account the high specific surface area of metal powders. Besides, even after the compacting and sintering operations, residual porosities may remain, such porosities acting as damage initiation sites during cyclic stressing. Furthermore, the chemical composition of the matrix/particle interfaces, and therefore their cohesion, is difficult to control given the surface contamination of the powders before sintering (presence of oxides and carbon). In addition, when ceramic particles are added in large quantity, or when certain large particles are present, the elongation properties decrease. Finally, this type of process is suitable for low-volume production but cannot meet the requirements of mass production in the automotive industry, and the manufacturing costs associated with this type of manufacturing process are high.

Manufacturing processes based on the extrinsic addition of ceramic powders into the liquid metal were also proposed. However, these processes suffer from most of the above-mentioned drawbacks. More particularly, the difficulty of homogeneously dispersing the particles may be mentioned, such particles having a tendency to agglomerate or to settle in or float on the liquid metal.

Among the known ceramics that could be used to increase the properties of steel is in particular titanium diboride $TiB_2$, which has the following intrinsic characteristics:

Elasticity modulus: 583 GPa;

Relative density: 4.52.

In order to produce a steel sheet or part having increased elasticity modulus and reduced density, whilst avoiding the above mentioned problems, it was proposed to produce steel sheets having a composition with C, Ti and B contents such that $TiB_2$, $Fe_2B$ and/or TiC precipitates form upon casting.

For example, EP 2 703 510 discloses a method for manufacturing a steel sheet having a composition comprises 0.21% to 1.5% of C, 4% to 12% of Ti and 1.5% to 3% of B, with $2.22 \times B \leq Ti$, the steel comprising TiC and $TiB_2$ precipitates having an average size of below 10 μm. The steel sheets are produced by casting the steel in the form of a semi-product, for example an ingot, then reheating, hot-rolling and optionally cold-rolling to obtain a steel sheet. With such a process, elasticity modulus in tension comprised between 230 and 255 GPa can be obtained.

However, this solution also suffers from several limitations, arising both from the composition and from the manufacturing method, and leading to castability issues, as well as formability issues during the manufacturing process and during the subsequent forming steps performed on the steel sheet to produce a part:

First, such steels have a low liquidus temperature (around 1300° C., so that the solidification starts at a relatively low temperature. In addition, the $TiB_2$, TiC and/or $Fe_2B$ precipitate at an early stage of the casting process, at the beginning of the solidification. The presence of these precipitates and the low temperature result in a hardening of the steel and lead to rheological issues, not only during the casting process, but also during the further crop shearing and rolling operations. In particular, the precipitates increase the hot hardness of the solidified shell in contact with the mold, causing surface defects and increasing the risks of breakout. Consequently, surface defects, bleedings and cracks occur during the manufacturing process. In addition, owing to the high hardness, the range of achievable sizes for the hot-rolled or cold-rolled steel sheets is limited. As an example, steel sheets 1 meter wide having a thickness lower than 3.5 mm cannot be produced in some hot strip mills due to rolling power limitation.

Second, despite the relatively small average size of the precipitates, the size distribution of the precipitates is wide. The steel thus comprises a substantial fraction of coarse precipitates, which negatively impact the formability, especially the ductility and the toughness of the steel, both during the manufacturing process of the sheet and during the subsequent forming operations to produce a part.

Besides, EP 1 897 963 discloses a method for manufacturing a steel sheet having a composition comprises 0.010% to 0.20% of C, 2.5% to 7.2% of Ti and $0.45 \times Ti - 0.35\% \leq B \leq 0.45 \times Ti + 0.70\%$, the steel comprising $TiB_2$ precipitates. However, this document does not address the problem of processability mentioned above.

SUMMARY

Therefore, the present disclosure aims at solving the above problems, in particular at providing a steel sheet having an increased specific elasticity modulus in tension together with a high formability, especially a high ductility and a high toughness. The present disclosure also aims at providing a manufacturing process of such a steel sheet, in which the above issues are not encountered.

The elasticity modulus in tension here designates the Young's modulus in the transverse direction, measured by a dynamic Young's modulus measurement, for example by a resonant frequency method.

The specific elasticity modulus in tension here refers to the ratio between the elasticity modulus in tension and the density of the steel. The density is for example determined using a helium pycnometer.

To that end, a steel sheet is provided made of a steel having a composition comprising, by weight percent:

$0.010\% \leq C \leq 0.080\%$
$0.06\% \leq Mn \leq 3\%$
$Si \leq 1.5\%$
$0.005\% \leq Al \leq 1.5\%$
$S \leq 0.030\%$
$P \leq 0.040\%$,
Ti and B such that:
$3.2\% \leq Ti \leq 7.5\%$
$(0.45 \times Ti) - 1.35 \leq B \leq (0.45 \times Ti) - 0.43$
optionally one or more elements chosen amongst:
$Ni \leq 1\%$
$Mo \leq 1\%$
$Cr \leq 3\%$
$Nb \leq 0.1\%$
$V \leq 0.1\%$ the remainder being iron and unavoidable impurities resulting from the smelting, said steel sheet having a structure consisting of ferrite, at most 10% of austenite, and precipitates, said precipitates comprising eutectic precipitates of $TiB_2$, the volume fraction of $TiB_2$ precipitates with respect to the whole structure being of at least 9%, the proportion of $TiB_2$ precipitates having a surface area lower than 8 $\mu m^2$ being of at least 96%.

Indeed, the inventors have found that with this composition, the content in free Ti of the steel is of at least 0.95%, and that owing to this content in free Ti, the structure of the steel remains mainly ferritic at any temperature below the liquidus temperature. As a result, the hot hardness of the steel is significantly reduced as compared to the steels of the state of the art, so that the castability and the hot formability are strongly increased.

In addition, the inventors have found that controlling the size distribution of the $TiB_2$ precipitates leads to a high formability, especially high ductility and toughness, at high and low temperatures, so that the hot and cold rollability of the steel is improved, and parts with complex shapes can be produced.

Preferably, the proportion of $TiB_2$ precipitates having a surface area lower than 3 $\mu m^2$ is of at least 80%.

Preferably, the proportion of $TiB_2$ precipitates having a surface area lower than 25 $\mu m^2$ is of 100%.

Preferably, in the core region of the steel sheet, the proportion of $TiB_2$ precipitates having a surface area lower than 8 $\mu m^2$ is of at least 96%, the proportion of $TiB_2$ precipitates having a surface area lower than 3 $\mu m^2$ is preferably of at least 80% and the proportion of $TiB_2$ precipitates having a surface area lower than 25 $\mu m^2$ is preferably of 100%.

Preferably, the steel sheet comprises no TiC precipitates, or TiC precipitates with a volume fraction lower than 0.5% (with respect to the whole structure).

Generally, the steel sheet comprises no $Fe_2B$ precipitates.

According to an embodiment, the titanium, boron and manganese contents are such that: $(0.45 \times Ti) - 1.35 \leq B \leq (0.45 \times Ti) - (0.261 \times Mn) - 0.414$.

According to an embodiment, the titanium and boron contents are such that:

$$(0.45 \times Ti) - 1.35 \leq B \leq (0.45 \times Ti) - 0.50.$$

According to an embodiment, the composition is such that $C \leq 0.050\%$.

Preferably, the composition is such that $Al \leq 1.3\%$.

Preferably, the steel sheet has a Charpy energy Kcv of at least 25 J/cm$^2$ at −40° C.

Generally, the steel sheet has a content in free Ti of at least 0.95%.

A process is also provided for manufacturing a steel sheet, the process comprising the following successive steps:

providing a steel having a composition comprising, by weight percent:
$0.010\% \leq C \leq 0.080\%$
$0.06\% \leq Mn \leq 3\%$
$Si \leq 1.5\%$
$0.005\% \leq Al \leq 1.5\%$
$S \leq 0.030\%$
$P \leq 0.040\%$,
Ti and B such that:
$3.2\% \leq Ti \leq 7.5\%$
$(0.45 \times Ti) - 1.35 \leq B \leq (0.45 \times Ti) - 0.43$
optionally one or more elements chosen amongst:
$Ni \leq 1\%$
$Mo \leq 1\%$
$Cr \leq 3\%$
$Nb \leq 0.1\%$
$V \leq 0.1\%$ the remainder being iron and unavoidable impurities, casting the steel in the form of a semi-product, the casting temperature being lower than or equal to $L_{liquidus}$+40° C., $L_{liquidus}$ designating the liquidus temperature of the steel, the semi-product being cast in the form of a thin semi-product having a thickness of at most 110 mm, the steel being solidified during the casting with a solidification rate comprised between 0.03 cm/s and 5 cm/s at every location of the semi-product.

Indeed, the inventors have found that controlling cooling of the solidification such that the solidification rate is of at least 0.03 cm/s at every location of the product, especially at the core of the product, makes it possible to control the size distribution of the $TiB_2$ precipitates. In addition, the casting under the form of a thin semi-product, with the composition of the present disclosure allows achieving such high solidification rates.

According to an embodiment, the semi-product is cast in the form of a thin slab having a thickness lower than or equal to 110 mm, preferably lower than or equal to 70 mm.

In an embodiment, the semi-product is cast in the form of a thin slab having a thickness comprised between 15 mm and 110 mm, preferably between 15 mm and 70 mm, for example between 20 mm and 70 mm.

Preferably, the semi-product is cast by compact strip production.

According to another embodiment, the semi-product is cast in the form of a thin strip having a thickness lower than or equal to 6 mm, the solidification rate being comprised between 0.2 cm/s and 5 cm/s at every location of the semi-product.

Preferably, the semi-product is cast by direct strip casting between counter-rotating rolls.

Generally, after casting and solidification, the semi-product is hot rolled, to obtain a hot-rolled steel sheet.

Preferably, between casting and hot-rolling, the temperature of the semi-product remains higher than 700° C.

Preferably, before hot-rolling, the semi-product is descaled at a temperature of at least 1050° C.

According to an embodiment, after hot-rolling, the hot-rolled steel sheet is cold-rolled, to obtain a cold-rolled steel sheet having a thickness lower than or equal to 2 mm.

Preferably, the titanium, boron and manganese contents are such that:

$$(0.45\times Ti)-1.35\leq B\leq(0.45\times Ti)-(0.261\times Mn)-0.414.$$

Preferably, the composition is such that Al≤1.3%.

A method for manufacturing a structural part is also provided, the method comprising:

cutting at least one blank from a steel sheet according to the present disclosure or produced by a process according to the present disclosure, and deforming said blank within a temperature range from 20° C. to 900° C.

According to an embodiment, the method comprises, before deforming the blank, a step of welding the blank to another blank.

A structural part is also provided comprising at least of portion made of a steel having a composition comprising, by weight percent:

0.010%≤C≤0.080%
0.06%≤Mn≤3%
Si≤1.5%
0.005%≤Al≤1.5%
S≤0.030%
P≤0.040%,
Ti and B such that:
3.2%≤Ti≤7.5%
(0.45×Ti)−1.35≤B≤(0.45×Ti)−0.43
optionally one or more elements chosen amongst:
Ni≤1%
Mo≤1%
Cr≤3%
Nb≤0.1%
V≤0.1% the remainder being iron and unavoidable impurities resulting from the smelting, said portion having a structure consisting of ferrite, at most 10% of austenite, and precipitates, said precipitates comprising eutectic precipitates of $TiB_2$, the volume fraction of $TiB_2$ precipitates with respect to the whole structure of said portion being of at least 9%, the proportion of $TiB_2$ precipitates having a surface area lower than 8 $\mu m^2$ being of at least 96%.

Preferably, the composition is such that Al≤1.3%.

Preferably, the structural part is obtained by the method according to the present disclosure.

BRIEF SUMMARY OF THE DRAWINGS

Other features and advantages of the present disclosure will become apparent over the course of the description below, given by way of non limiting example and with reference to the appended figures in which.

DETAILED DESCRIPTION

Figure 2:
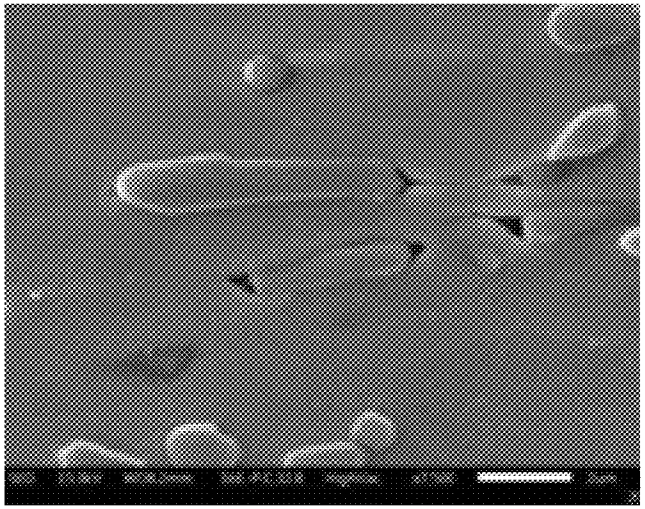
FIG. 2 is a micrograph illustrating the damage mechanism of individual fine $TiB_2$ precipitates.

As regards the chemical composition of the steel, the carbon content is adapted for achieving the desired level of strength. For this reason, the carbon content is of at least 0.010%.

However, the C content must be limited in order to avoid primary precipitation of TiC and/or Ti(C,N) in the liquid steel, and precipitation of TiC and/or Ti(C,N) during eutectic solidification and in the solid phase fraction, that could otherwise occur owing to the high Ti content of the steel. Indeed, TiC and Ti(C,N) precipitating in the liquid steel would deteriorate the castability by increasing the hot hardness of the solidified shell during the casting and lead to cracks in the cast product. In addition, the presence of TiC precipitates decreases the content in free Ti in the steel, and therefore inhibits the alphageneous role of Ti. For these reasons, the C content must be of at most 0.080%. Preferably, the C content is of at most 0.050%.

In a content of at least 0.06%, manganese increases the hardenability and contributes to the solid-solution hardening and therefore increases the tensile strength. It combines with any sulfur present, thus reducing the risk of hot cracking. However, if the Mn content is higher than 3%, the structure of the steel will not be mainly ferritic at all temperatures, so that the hot hardness of the steel will be too high, as explained in further details below.

Silicon effectively contributes to increasing the tensile strength by solid solution hardening. However, excessive addition of Si causes the formation of adherent oxides that are difficult to remove by pickling, and the possible formation of surface defects due in particular to a lack of wettability in hot-dip galvanizing operations. To ensure a good coatability, the Si content must not exceed 1.5%.

In a content of at least 0.005%, aluminum is a very effective element for deoxidizing the steel. However, in a content above 1.5%, excessive primary precipitation of alumina occurs, impairing the castability of the steel.

Preferably, the Al content is lower than or equal to 1.3%, so as to achieve a further improved castability.

In a content higher than 0.030%, sulfur tends to precipitate in excessively large amounts in the form of manganese sulfides, which reduce to a large extent the hot and cold formability of the steel. Therefore, the S content is of at most 0.030%.

Phosphorus is an element that segregates at the grain boundaries. Its content must not exceed 0.040% so as to maintain sufficient hot ductility, thereby avoiding cracking, and to prevent hot cracking during welding operations.

Optionally, nickel and/or molybdenum may be added, these elements increasing the tensile strength of the steel. For cost reasons, the additions of Ni and Mo are each limited to 1%.

Optionally, chromium may be added to increase the tensile strength, the Cr content being limited to at most 3% for cost reasons. Cr also promotes the precipitation of borides. However, the addition of Cr above 0.080% may promote the precipitation of (Fe, Cr) borides, to the detriment of $TiB_2$ precipitates. Therefore, the Cr content is preferably of at most 0.080%.

Also optionally, niobium and vanadium may be added in an amount equal to or less than 0.1% so as to obtain complementary hardening in the form of fine precipitated carbonitrides.

Titanium and boron play an important role in the present disclosure. Indeed, Ti and B precipitate under the form of $TiB_2$ precipitates which significantly increase the elasticity modulus in tension E of the steel. $TiB_2$ may precipitate at an early stage of the manufacturing process, especially under the form of primary $TiB_2$ precipitating in the liquid steel, and/or as eutectic precipitates.

However, the inventors have found that the $TiB_2$ precipitates may lead to an increase in the hot hardness of the solidified shell during the casting and thereby results in the formation of cracks in the cast product, in the appearance of surface defects and in a decrease in the hot rollability of the steel which limit the accessible thickness range for the hot-rolled steel sheet.

Surprisingly, the inventors have found that if the Ti and the B content are adjusted such that the content of free Ti (hereinafter Ti*) is higher than or equal to 0.95%, the hot hardness of the steel is significantly reduced. Indeed, the inventors have found that under this condition, the steel remains mainly ferritic, i.e. comprises at most 10% of austenite, whatever the temperature (below the liquidus), especially during the solidification and the hot-rolling, which leads to a decrease of the hot hardness of the steel as compared to a steel undergoing an allotropic transformation of more than 10% on cooling. Thus, the castability and the hot ductility of the steel are improved to a large extent, despite the formation of $TiB_2$ in the steel during solidification.

The "free Ti" here designates the content of Ti not bound under the form of precipitates.

In addition, a Ti* content of at least 0.95% greatly reduces, and even suppresses the formation of $Fe_2B$ that would impair the ductility.

Preferably, the Ti* content is higher than or equal to 0.92+0.58×Mn, wherein Mn designates the Mn content in the steel. Indeed, Mn is a gammageneous element that may favor the presence of austenite in the structure. Thus, the Ti* is preferably adjusted depending on the Mn content so as to ensure that the steel remains mainly ferritic whatever the temperature.

However, the Ti* content should remain lower than 3%, as no significant beneficial technical effect would be obtained from a Ti* content higher than 3%, despite the higher cost of adding titanium.

In order to ensure a sufficient $TiB_2$ precipitation, and in the same time allow the content Ti* to reach 0.95%, the Ti content must be of at least 3.2%. If the Ti content is lower than 3.2%, the $TiB_2$ precipitation is not sufficient, thereby precluding a significant increase in the elasticity modulus in tension, which remains lower than 220 GPa.

However, if the Ti content is higher than 7.5%, coarse primary $TiB_2$ precipitation may occur in the liquid steel and cause castability problems in the semi-product, as well as a reduction of the ductility of the steel leading to a poor hot and cold rollability.

Therefore, the Ti content is comprised between 3.2% and 7.5%.

Besides, in order to ensure a Ti* content of at least 0.95%, the boron content should be of at most (0.45×Ti)−0.43, Ti designating the Ti content by weight percent.

If B>(0.45×Ti)−0.43, the Ti* content will not reach 0.95%. Indeed, the Ti* content can be evaluated as Ti*=Ti−2.215×B, B designating the B content in the steel. As a consequence, if B>(0.45×Ti)−0.43, the structure of the steel will not be mainly ferritic during the casting and the hot rolling operations, so that its hot ductility will be reduced, which may lead to the formation of cracks and/or surface defects during the casting and hot rolling operations.

If a Ti* content higher than or equal to 0.92+0.58*Mn is targeted, the boron content should be of at most (0.45×Ti)−(0.261×Mn)−0.414, Ti and Mn designating the Ti and Mn content by weight percent.

If B>(0.45×Ti)−(0.261×Mn)−0.414, the Ti* content will not reach 0.92+0.58×Mn.

The boron content should however be higher than or equal to (0.45×Ti)−1.35 to ensure a sufficient precipitation of $TiB_2$. In addition, a B content lower than (0.45×Ti)−1.35 would corresponds to a Ti* content higher than 3%.

The balance is iron and residual elements resulting from the steelmaking.

According to the present disclosure, the structure of the steel is mainly ferritic whatever the temperature (below $T_{liquidus}$). By "mainly ferritic", it must be understood that the structure of the steel consists of ferrite, precipitates (especially $TiB_2$ precipitates) and at most 10% of austenite.

Thus, the steel sheet according to the present disclosure has a structure which is mainly ferritic at all temperatures, especially at room temperature. The structure of the steel sheet at room temperature is generally ferritic, i.e. comprises no austenite.

The ferritic grain size is generally lower than 6 μm.

The volume fraction of $TiB_2$ precipitates is of at least 9%, so as to obtain an elasticity modulus in tension E of at least 230 GPa.

The volume fraction of $TiB_2$ precipitates is preferably of at least 12%, so as to obtain an elasticity modulus in tension E of at least 240 GPa.

The $TiB_2$ precipitates mainly result from very fine eutectic precipitation upon solidification, the mean surface area of the $TiB_2$ precipitates being preferably lower than 8.5 $\mu m^2$, still preferably lower than 4.5 $\mu m^2$, still preferably lower than 3 $\mu m^2$.

The inventors have found that the size of the $TiB_2$ precipitates in the steel have an influence on the properties of the steel, in particular on the damage resistance of the product during its manufacture, especially its hot and cold rollability, on the damage resistance of the steel sheet, especially during the forming operation, its fatigue strength, its fracture stress and its toughness.

However, the inventors have found that the main factor for ensuring a high damage resistance and therefore a high formability is the size distribution of the $TiB_2$ precipitates.

Indeed, the inventors have found that in a steel comprising $TiB_2$ precipitates, the damages occurring during the manufacture, especially during the hot and/or cold rolling steps and the further forming operations, may result from damages undergone by individual precipitates, and from collisions between the precipitates.

Especially, damage initiation of the individual $TiB_2$ precipitates comes from pile-up of dislocations at the interface between the ferrite and the $TiB_2$ precipitates, and depends on the size of the $TiB_2$ precipitates. In particular, the fracture stress of the $TiB_2$ precipitates is a decreasing function of the $TiB_2$ precipitate size. If the size of some of the $TiB_2$ precipitates increases such that the fracture stress of these precipitates becomes lower than the interface disbonding stress, the damage mechanism changes from interface disbonding to fracture of the $TiB_2$ precipitates, leading to a significant decrease of the ductility, formability and toughness.

Figure 1:
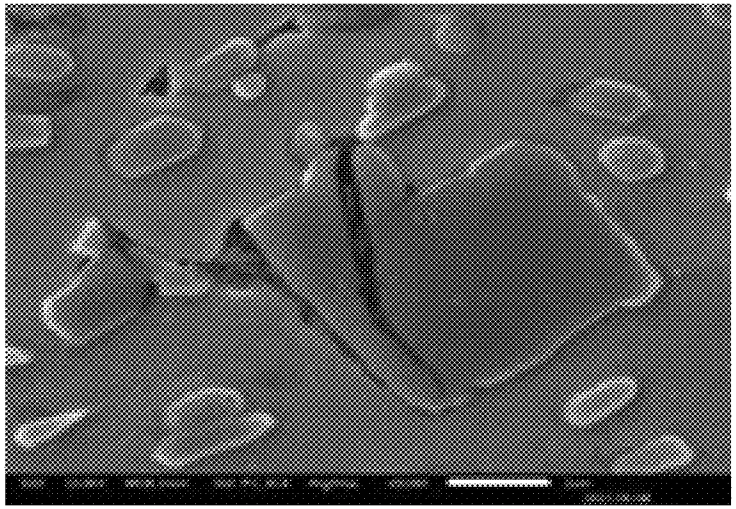
FIG. 1 is a micrograph illustrating the damage mechanism of individual coarse $TiB_2$ precipitates.

This change in damage mechanism is illustrated by FIGS. 1 and 2.

FIG. 1 illustrates the damage of a coarse $TiB_2$ precipitate under compressive stress during cold-rolling: in that case, the $TiB_2$ precipitate is fractured along a direction parallel to the compressive stress, under a relatively low stress.

By contrast, FIG. 2 illustrates the interface disbonding of smaller $TiB_2$ precipitates during cold-rolling, by the appearance of cavities at the interface between the ferritic matrix and the $TiB_2$ precipitates.

Consequently, if a steel sheet, though having $TiB_2$ precipitates with a reduced mean size, comprises large $TiB_2$ precipitates, these large $TiB_2$ precipitates will cause a change in the damage mechanism of the steel and a decrease of the steel mechanical properties.

Besides, the inventors have found that the damages resulting from collisions between $TiB_2$ precipitates are all the more important that the size of these precipitates is large. In particular, whereas a collision between coarse $TiB_2$ precipitates results in a fracture of these precipitates, a collision of small $TiB_2$ precipitates does not lead to such fracture.

Figure 3:
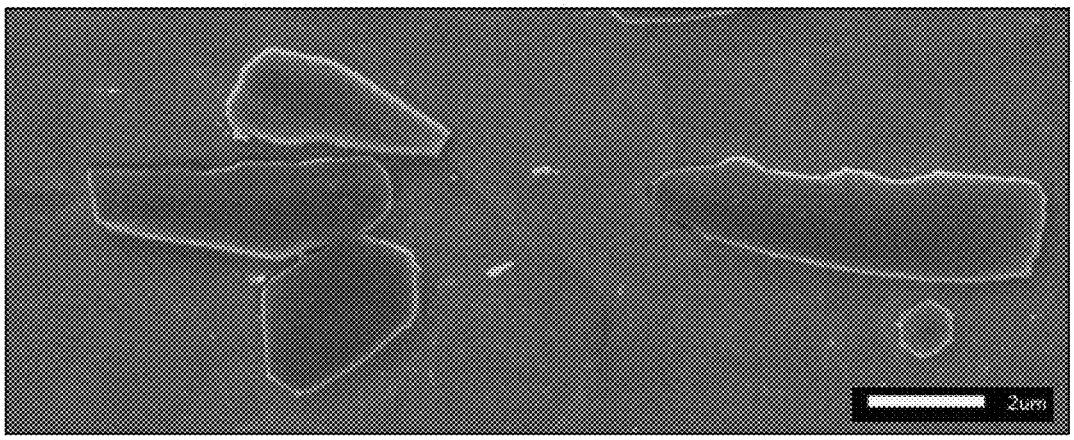
FIG. 3 is a micrograph illustrating fine $TiB_2$ precipitates after a collision of these precipitates.
Figure 4:
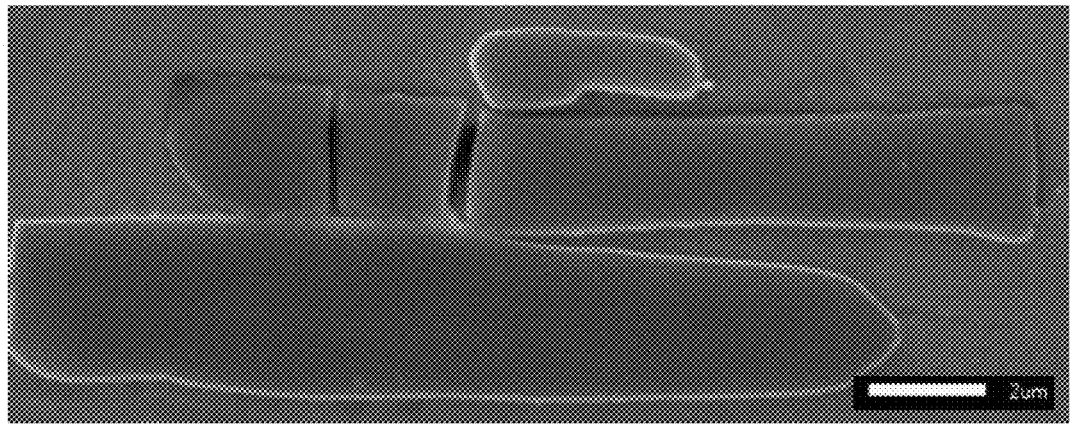
FIG. 4 is a micrograph illustrating coarse $TiB_2$ precipitates after a collision of these precipitates.

FIGS. 3 and 4 illustrate precipitates of different sizes further to a collision.

Especially, FIGS. 3 and 4 illustrate fine precipitates and large $TiB_2$ precipitates after a collision respectively. These figures show that the collision of the large precipitates led to a fracture of one of the colliding precipitates, whereas the collision of the fine precipitates did not result in any damage.

In order to ensure high ductility, formability and toughness, the inventors have found that the distribution of the size of the $TiB_2$ precipitates must be such that the proportion of $TiB_2$ precipitates having a surface area lower than 8 $\mu m^2$ is of at least 96%.

Moreover, the proportion of $TiB_2$ precipitates having a surface area lower than 3 $\mu m^2$ should preferably be of at least 80%, and the proportion of $TiB_2$ precipitates having a surface area lower than 25 $\mu m^2$ should preferably be of 100%.

The proportion of $TiB_2$ precipitates having a surface area lower than 3 $\mu m^2$, 8 $\mu m^2$ or 25 $\mu m^2$ is defined as the number of $TiB_2$ precipitates having a surface area lower than 3 $\mu m^2$, 8 $\mu m^2$ or 25 $\mu m^2$, divided by the number of $TiB_2$ precipitates, and multiplied by a factor 100.

The proportion of $TiB_2$ precipitates having a surface area lower than 3 $\mu m^2$, 8 $\mu m^2$ or 25 $\mu m^2$ is preferably determined on a specimen prepared using standard metallographic technique for surface preparation and etched with nital reagent, by image analysis using a Scanning Electron Microscope (SEM).

Especially, at the core of the sheet, the distribution of the size of the $TiB_2$ precipitates must be such that the proportion of $TiB_2$ precipitates having a surface area lower than 8 $\mu m^2$ is of at least 96%, and preferably such that the proportion of $TiB_2$ precipitates having a surface area lower than 3 $\mu m^2$ is of at least 80%, still preferably such that the proportion of $TiB_2$ precipitates having a surface area lower than 25 $\mu m^2$ is of 100%.

By considering a sheet having a generally rectangular shape having a length l1 in a longitudinal direction, a width w1 in the transversal direction and a thickness t1 in the thickness direction, the core of the sheet is defined as the portion of the sheet extending over the length l1 and over the width w1, in the thickness direction of the sheet, from a first end located at 45% of the overall thickness t1 of the sheet to a second end located at 55% of the overall thickness t1 of the sheet.

Indeed, the inventors have found that under this condition, the damages occur by interface disbonding, so that the damage kinetics is delayed. Besides, under this condition, the damages that may result from collisions between $TiB_2$ precipitates are highly reduced.

As a consequence, the formability and the ductility of the steel sheet during its manufacture and in use are greatly improved.

In particular, the reduction ratio achievable through cold-rolling is increased, and the formability is increased, so that parts with complex shapes can be formed.

Having a proportion of $TiB_2$ precipitates having a surface area lower than 8 $\mu m^2$ of at least 96% is critical. Indeed, the inventors have found that below this value, the coarse $TiB_2$ precipitates cause a change in damage mechanism, as explained above, which drastically reduces the damage resistance of the steel.

Besides, the steel sheet according to the present disclosure comprises no or a small fraction of TiC precipitates, the volume fraction of TiC precipitates in the structure remaining lower than 0.5%, generally lower than 0.36%.

Indeed, as explained above, TiC precipitates, if present, would have formed in the liquid steel, and would have deteriorated the castability of the steel, so that a fraction of TiC precipitates in the structure higher than 0.5% would result in cracks and/or surface defects in the steel sheet. The presence of TiC precipitates further decreases the ductility of the steel.

In addition, owing to the high Ti* content, the steel sheet does not comprise any $Fe_2B$ precipitates, the volume fraction of $Fe_2B$ precipitates in the structure being of 0%. The absence of $Fe_2B$ precipitates increases the ductility of the steel sheet.

The steel sheet, whether hot-rolled or cold-rolled, has a very high toughness, even at low temperatures. Especially, the transition temperature from ductile mode to mixed mode is lower than −20° C., and the Charpy energy Kcv of the steel sheet is generally higher than or equal to 25 J/cm$^2$ at −40° C., and higher than or equal to 20 J/cm$^2$ at −60° C.

The steel sheet has an elasticity modulus in tension E of at least 230 GPa, generally of at least 240 GPa, a tensile strength TS of at least 640 MPa and a yield strength of at least 250 MPa before any skin-pass. Thus, a non skin-passed sheet according to the present disclosure generally has a yield strength of at least 250 MPa.

The high tensile strength, of at least 640 MPa, is especially achieved owing to the small size and the size distribution of the $TiB_2$ precipitates in the steel of the present disclosure, due to the Hall-Petch effect and increased work-hardening.

The elasticity modulus in tension is an increasing function of the fraction of $TiB_2$ precipitates.

Especially, an elasticity modulus in tension E of at least 230 GPa is achieved with a fraction of $TiB_2$ precipitates of 9% or higher. In the preferred embodiment wherein the volume fraction of $TiB_2$ precipitates is of at least 12%, an elasticity modulus in tension E of at least 240 GPa is achieved.

Besides, the presence of $TiB_2$ precipitates leads to a decrease of the density of the steel.

As a consequence, the steel sheet of the present disclosure has a very high specific elasticity modulus in tension.

A process for manufacturing a steel sheet according to the present disclosure is implemented as follows.

A steel with the composition according to the present disclosure is provided, and the steel is then cast into a semi-product.

The casting is performed at a temperature lower than or equal to $T_{liquidus}$+40° C., $T_{liquidus}$ designating the liquidus temperature of the steel.

Indeed, a casting temperature higher than $T_{liquidus}$+40° C. could lead to the formation of coarse $TiB_2$ precipitates.

The liquidus temperature $T_{liquidus}$ of the steel of the present disclosure is generally comprised between 1290° C. and 1310° C. Therefore, the casting temperature should generally be of at most 1350° C.

The casting is carried out so as to form upon casting a thin product, having a thickness of at most 110 mm, especially a thin slab or a thin strip.

To that end, the casting is preferably performed by compact strip production, to form a thin slab having a thickness lower than or equal to 110 mm, preferably of at most 70 mm, or by direct strip casting between counter-rotating rolls, to form a thin strip having a thickness lower than or equal to 6 mm.

In any case, the thickness of the semi-product must be of at most 110 mm, and preferably of at most 70 mm.

For example, the semi-product is cast in the form of a thin slab having a thickness comprised between 15 mm and 110 mm, preferably between 15 mm and 70 mm, for example between 20 mm and 70 mm.

Casting the semi-product under the form of a thin semi-product, for example a thin slab or strip, improves the processability of the steel by limiting the damage of the steel during rolling and forming operations.

Indeed, casting the semi-product under the form of a thin semi-product, for example a thin slab or strip allows using during the subsequent rolling steps a lower reduction rate to achieve the desired thickness.

A decrease in the reduction rate limits the damage of the steel that may result from collisions of the $TiB_2$ precipitates during hot and cold rolling operations.

Most of all, the casting under the form of a thin semi-product allows achieving very fine $TiB_2$ precipitates, so that the damage that may result from collisions of $TiB_2$ precipitates and the damage of individual $TiB_2$ precipitates are reduced, as explained above.

Especially, the casting under the form of a thin semi-product allows a fine control of the solidification rate upon cooling across the thickness of the sheet, ensures a solidification rate fast enough in the whole product and minimizes the difference in solidification rate between the surface of the product and the core of the product.

Indeed, achieving a sufficient and homogeneous solidification rate is necessary to obtaining very fine $TiB_2$ precipitates, not only at the surface of the product, but also at the core of the semi-product. By considering a semi-product having a generally rectangular shape having a length l2 in a longitudinal direction, a width w2 in the transversal direction and a thickness t2 in the thickness direction, the core (or core region) of the semi-product is defined as the portion of the semi-product extending over the length l2 and over the width w2, in the thickness direction of the semi-product, from a first end located at 45% of the overall thickness t2 of the semi-product, to a second end located at 55% of the overall thickness of the semi-product.

The inventors have further found that in order to obtain very fine $TiB_2$ precipitates such that the proportion of $TiB_2$ precipitates having a surface area lower than 8 $\mu m^2$ is of at least 96%, the cooling conditions during the solidification must be such that the steel is solidified with a solidification rate equal to or greater than 0.03 cm/s, up to 5 cm/s, at every location of the semi-product.

Owing to the decrease of the solidification rate from the surface to the core of the product, a solidification rate of at least 0.03 cm/s at every location implies that the solidification rate at the core of the product is of at least 0.03 cm/s, up to 5 cm/s.

Besides, if the semi-product is cast under the form of a thin strip, especially by direct strip casting between counter-rotating rolls, to form a thin strip having a thickness lower than or equal to 6 mm, the solidification rate is comprised between 0.2 cm/s and 5 cm/s at every location of the semi-product.

Indeed, the inventors have found that a solidification rate of at least 0.03 cm/s at every location, especially at the core of the product, allows obtaining very fine $TiB_2$ precipitates, not only at the surface of the product but also throughout the whole thickness of the product, such that the mean area surface is lower than 8.5 $\mu m^2$ and the proportion of $TiB_2$ precipitates having a surface area lower than 8 $\mu m^2$ is of at least 96%. In addition, the proportion of $TiB_2$ precipitates having a surface area lower than 3 $\mu m^2$ is of at least 80%, and the proportion of $TiB_2$ precipitates having a surface area lower than 25 $\mu m^2$ is of 100%.

Especially, a solidification rate of at least 0.03 cm/s in the core region of the product allows obtaining very fine $TiB_2$ precipitates in the core region of the semi-product, such that the mean area surface is lower than 8.5 $\mu m^2$ and the proportion of $TiB_2$ precipitates having a surface area lower than 8 $\mu m^2$ is of at least 96%. In addition, the proportion of $TiB_2$ precipitates having a surface area lower than 3 $\mu m^2$ is of at least 80%, and the proportion of $TiB_2$ precipitates having a surface area lower than 25 $\mu m^2$ is of 100%.

By contrast, if the solidification rate at least some parts of the product is lower than 0.03 cm/s, TiC precipitates and/or coarse $TiB_2$ precipitates will form during solidification.

The control of the cooling and solidification rates to the above values is achieved owing to the casting of the steel in the form of a thin semi-product with a thickness lower than 110 mm, and to the composition of the steel.

Especially, the casting in the form of a thin semi-product results in a high cooling rate across the product thickness and in an improved homogeneity of the solidification rate from the surface to the core of the product.

In addition, owing to the high Ti* content of the steel, the steel solidifies mainly as ferrite. Especially, the solidified steel has a mainly ferritic structure from the start of solidification and during the whole solidification process, the austenite fraction in the steel remaining of at most 10%. Thus, no or very limited phase transformation occurs during the cooling.

As a result the steel can be cooled by rewetting, rather than by film boiling, which allows reaching very high solidification rates.

Film boiling is a cooling mode in which a thin layer of vapor of cooling fluid, having a low thermal conductivity, is interposed between the surface of the steel and the liquid cooling fluid. In film boiling, the heat transfer coefficient is low. By contrast, cooling by rewetting occurs when the vapor layer is fractured, and the cooling fluid becomes in contact with the steel. This cooling mode occurs when the temperature of the surface of the steel is lower than the Leidenfrost temperature. The heat transfer coefficient achieved through rewetting is higher than the heat transfer coefficient achievable through film boiling, so that the solidification rate is increased. However, if phase transformations occur during cooling by rewetting, the coupling between rewetting and phase transformation induces high strains in the steel resulting in cracks and surface defects.

Therefore, steels enduring a significant allotropic transformation during solidification cannot be cooled by rewetting.

By contrast, in the steels of the present disclosure, which comprise at most 10% of austenite at any temperature, little or no phase transformation occurs upon solidification, and the steel can therefore be cooled by rewetting.

Thus, very high solidification rates can be achieved.

At the end of the solidification, the structure of the steel is mainly ferritic and comprises very fine eutectic $TiB_2$ precipitates.

In addition, owing to the mainly ferritic structure of the steel as soon as the solidification starts, no or little transformation of 8 ferrite into austenite occurs during solidification (i.e. at most 10% of 8 ferrite transforms into austenite during solidification), so that the local contractions that would result from this transformation, which could lead to cracks in the semi-product, are avoided.

In particular, in the absence of significant transformation of 8 ferrite into austenite, no peritectic induced precipitation occurs during solidification. Such peritectic induced precipitation, occurring in the dendrites, could lead to a decrease of the hot ductility and induce cracks, especially during the further hot rolling.

Therefore, the solidified semi-product has a very good surface quality and comprises no or very few cracks.

Moreover, the solidification of the steel as mainly ferrite, as compared to a structure comprising more than 10% of austenite at the solidification, reduces to a large extent the hardness of the solidified steel, in particular the hardness of the solidified shell.

Especially, the hardness of the steel is about 40% lower than a comparable steel that would have an structure comprising more than 10% of austenite during solidification.

The low hot hardness of the solidified steel results in a reduction of the rheological issues involving the solidified shell, especially avoids the occurrence of surface defects, depression and bleedings in the cast product.

In addition, the low hot hardness of the solidified steel also guarantees a high hot ductility of the steel, as compared to allotropic grades.

Owing to the high hot ductility of the product, the formation of cracks, that would otherwise appear during the bending and straightening operations of the casting process, and/or during the subsequent hot rolling, is avoided.

After solidification, the semi-product is cooled to an end of cooling temperature which is preferably of not less than 700° C. At the end of the cooling, the structure of the semi-product remains mainly ferritic.

The semi-product is then heated, from the end of cooling temperature to about 1200° C., de-scaled then hot-rolled.

During de-scaling, the temperature of the surface of the steel is preferably of at least 1050° C. Indeed, below 1050° C., liquid oxides will solidify on the surface of the semi-product, which may cause surface defects.

Preferably, the semi-product is directly hot-rolled, i.e. is not cooled to a temperature below 700° C. before hot-rolling, such that the temperature of the semi-product remains at any time higher than or equal to 700° C. between the casting and the hot-rolling. The direct hot-rolling of the semi-product allows reducing the time necessary for homogenizing the temperature of the semi-product before hot-rolling, and therefore limiting the formation of liquid oxides at the surface of the semi-product.

In addition, the as cast semi-product is generally brittle at low temperatures, so that directly hot-rolling the semi-product allows avoiding cracks that may otherwise occur at low temperatures due to the brittleness of the as cast semi-product.

The hot-rolling is for example performed in a temperature range comprised between 1100° C. and 900° C., preferably between 1050° C. and 900° C.

As explained above, the hot ductility of the semi-product is very high, owing to the mainly ferritic structure of the steel. Indeed, no or little phase transformation, which would reduce the ductility, occurs in the steel during hot-rolling.

As a consequence, the hot rollability of the semi-product is satisfactory, even with a hot-rolling finish temperature of 900° C., and the appearance of cracks in the steel sheet during hot-rolling is avoided.

For example, hot-rolled steel sheets having a thickness comprised between 1.5 mm and 4 mm, for example comprised between 1.5 mm and 2 mm, are obtained.

After hot-rolling, the steel sheet is preferably coiled. The hot-rolled steel sheet is then preferably pickled, for example in an HCl bath, to guarantee a good surface quality Optionally, if a lower thickness is desired, the hot-rolled steel sheet is subjected to cold-rolling, so as to obtain a cold-rolled steel sheet having a thickness of less than 2 mm, for example comprised between 0.9 mm and 1.2 mm.

Such thicknesses are achieved without producing any significant internal damage. This absence of significant damage is especially due to the casting under the form of a thin semi-product and to the composition of the steel.

Indeed, since the cold-rolled sheet is produced from a thin product, the hot and cold reduction ratios necessary to achieve a given thickness is reduced. Therefore, the occurrence of collisions between the $TiB_2$ precipitates, which could lead to damage, is reduced.

Furthermore, owing to the size distribution of the $TiB_2$ precipitates, achieved thanks to the low thickness of the semi-product and to the composition, cold reduction ratios of up to 40%, and even of up to 50% can be achieved without producing any significant internal damage.

Indeed, since the steel comprises no coarse $TiB_2$ precipitates, the damages occur by interface disbonding, so that the damage kinetics is delayed. Besides, the collision of the $TiB_2$ precipitates, owing to their small sizes, does not lead to any significant damage.

As a consequence, the occurrence of damages during cold-rolling is highly reduced.

After cold-rolling, the cold-rolled steel sheet may be subjected to an annealing. The annealing is for example performed by heating the cold-rolled steel sheet at a mean heating rate preferably comprised between 2 and 4° C./s, to an annealing temperature comprised between 800° C. and 900° C., and holding the cold-rolled steel sheet at this annealing temperature for an annealing time generally comprised between 45 s and 90 s.

The steel sheet thus obtained, which may be hot-rolled or cold rolled, has a mainly ferritic structure, i.e. consists of ferrite, at most 10% of austenite, and precipitates. Generally, the steel sheet thus obtained has a ferritic structure at room temperature, i.e. a structure consisting of ferrite and precipitates, without austenite.

The steel sheet thus obtained comprises $TiB_2$ precipitates, which are eutectic $TiB_2$ precipitates, the volume fraction of $TiB_2$ precipitates being of at least 9%.

The proportion of $TiB_2$ precipitates in the steel sheet having a surface area lower than 8 $\mu m^2$ is of at least 96%. In addition, the proportion of $TiB_2$ precipitates having a surface area lower than 3 $\mu m^2$ is preferably of at least 80%, and the proportion of $TiB_2$ precipitates having a surface area lower than 25 $\mu m^2$ is preferably of 100%.

This is especially the case in the core region of the sheet.

The steel sheet thus obtained comprises a very small amount of TiC precipitates, owing to the low C content of the steel and to the manufacturing process, and to the absence of peritectic induced precipitation during solidification. The volume fraction of TiC precipitates in the structure is in particular lower than 0.5%, generally lower than 0.36%.

The steel sheet thus obtained comprises no $Fe_2B$ precipitates.

With this manufacturing process, the formation of surface defects and cracks in the cast product and the steel sheet is avoided.

Especially, the reduction in hardness achieved owing to the high Ti* content allows avoiding the occurrence of surface defects, depression and bleedings in the cast product.

In addition, the steel sheet thus obtained has very high formability, toughness and fatigue strength, so that the parts with complex geometry can be produced from such sheets.

Especially, the damages in the steel sheet that may result from hot and/or cold-rolling are minimized, so that steel has an improved ductility during the subsequent forming operations and an improved toughness.

Furthermore, the high elasticity modulus in tension of the steel according to the present disclosure reduces the springback after the forming operations and thereby increases the dimensional precision on the finished parts.

To produce a part, the steel sheet is cut to produce a blank, and the blank is deformed, for example by drawing or bending, in a temperature range comprised between 20 and 900° C.

Advantageously, structural elements are manufactured by welding a steel sheet or blank according to the present disclosure to another steel sheet or blank, having an identical or a different composition, and having an identical or a different thickness, so as to obtain a welded assembly with varying mechanical properties, which can be further deformed to produce a part.

For example, the steel sheet according to the present disclosure may be welded to a steel sheet made of a steel having a composition comprising, by weight percent:

0.01%≤C≤0.25%
0.05%≤Mn≤2%
Si≤0.4%
Al≤0.1%
Ti≤0.1%
Nb≤0.1%
V≤0.1%
Cr≤3%
Mo≤1%
Ni≤1%
B≤0.003% the remainder being iron and unavoidable impurities resulting from the smelting.

Examples

As examples and comparison, sheets made of steel compositions according to table I, have been manufactured, the elements being expressed in weight percent.

TABLE 1

| | C | Mn | Si | Al | S | P | Ti | B | Cr | Ti* = Ti − 2.215 × B |
|---|---|---|---|---|---|---|---|---|---|---|
| A | 0.0227 | 0.061 | 0.168 | 0.039 | 0.0067 | 0.008 | 5.32 | 1.67 | 0.12 | 1.6 |
| B | 0.04 | 0.09 | 0.14 | 0.146 | 0.0015 | 0.009 | 6.34 | 2.34 | 0.075 | 1.16 |
| C | 0.036 | 0.07 | 0.15 | 0.065 | 0.001 | 0.01 | 5.3 | 2.05 | 0.05 | 0.75 |

In Table 1, the underline value is not according to the present disclosure.

These steels were cast in the form of semi-products:

steel A was continuously cast in the form of a slab having a thickness of 65 mm (sample I1), steel B was cast in the form of a ingot of 300 kg, having a section of 130 mm×130 mm (sample R1), steel C was cast in the form of a thin slab having a thickness of 45 mm (sample R2).

The solidification rates during solidification of the cast products were assessed at the surface and at the core of the products, and are reported in Table 2 below.

TABLE 2

| Sample reference | Steel composition | At the surface (cm/s) | At the core (cm/s) |
|---|---|---|---|
| I1 | A | 0.3 | 0.06 |
| R1 | B | 0.001 | 0.0001 |
| R2 | C | 0.3 | 0.01 |

In Table 2, the underlined values are not according to the present disclosure.

Sample I1 was cast under the form of a thin slab, having a thickness lower than 110 mm.

In addition, the composition (A) of sample I1 is in accordance with the present disclosure, and has therefore a content in free Ti of at least 0.95%, so that during the solidification, no or little phase transformation occurred, allowing cooling by rewetting.

Owing to the low thickness of the cast product and to the cooling by rewetting, the solidification rate for sample I1 could be higher than 0.03 cm/s, even at the core of the semi-product.

By contrast, sample R1 has a composition (B) according to the present disclosure, but was not cast as a thin semi-product, its thickness being higher than 110 mm.

As a consequence, the solidification rate could not reach the targeted values, neither at the core nor at the surface of the semi-product.

Sample R2 does not have a composition (C) in accordance with the present disclosure, its B content being higher than (0.45×Ti)−0.43. Thus, sample R2 has a content in free Ti lower than 0.95% (0.75%).

Thus, even if the steel was cast under the form of a thin strip, an important phase transformation occurring during solidification, so that the cooling could not be performed by rewetting. As a result, the solidification rate did not reach 0.03 cm/s at the core of the product.

The inventors have investigated the hot formability of samples I1 and R2.

Especially, the hot formability of as cast samples I1 and R2 was assessed by performing hot plane strain compression tests with various strain rates as temperatures ranging from 950° C. to 1200° C.

To that end, Rastegaiev specimens were sampled from as cast samples I1 and R2. The specimens were heated to a temperature of 950° C., 1000° C., 1100° C. or 1200° C., and then compressed by two punches, located of opposite sides of the specimen, with various strain rates of 0.1 $s^{-1}$, 1 $s^{-1}$, 10 $s^{-1}$ or 50 $s^{-1}$. The stresses were determined, and for each test, the maximum stress was assessed.

Table 3 below reports at each temperature and for each of the samples I1 and R2 the fraction of austenite in the structure at this temperature, and the maximal stress determined at each temperature for each strain rate.

TABLE 3

| | 950° C. | | 1000° C. | | 1100° C. | | 1200° C. | |
|---|---|---|---|---|---|---|---|---|
| | I1 | R2 | I1 | R2 | I1 | R2 | I1 | R2 |
| % of austenite | <10% | 100% | <10% | 100% | <10% | 100% | <10% | 100% |
| Strain rate ($s^{-1}$) | Stress max (MPa) | | | | | | | |
| 0.1 | 93 | 196 | 70 | 169.5 | 47 | 127 | 27 | 81 |
| 1 | 138 | 230 | 108 | 209 | 75 | 164 | 53 | 112 |
| 10 | 199 | 270 | 169 | 253 | 125 | 212 | 90 | 153 |
| 50 | 236 | 316 | 204 | 294 | 155 | 250 | 126 | 191 |

These results show that the maximum stress reached for sample I1 is much lower than for sample R2, whatever the temperature comprised between 950° C. and 1200° C. and whatever the strain rate, the maximum stress for steel I1 being of up to 67% lower than the maximum stress reached for steel R2.

This reduction of the maximum stress results especially from the difference between the structure of sample I1, which is mainly ferritic at all temperatures, and the structure of sample R2, which endures phase transformation and becomes austenitic at high temperatures. This reduction implies that at high temperatures, the hardness of the steel of the present disclosure is reduced to a large extent as compared to a steel having a Ti* content lower than 0.95%, the hot formability being thereby improved.

The hot formability of as cast samples I1 and R2 was further assessed by performing high temperature tensile test on a thermomechanical simulator Gleeble.

Especially, the reduction of area was determined at temperatures ranging from 600° C. to 1100° C.

Figure 5:
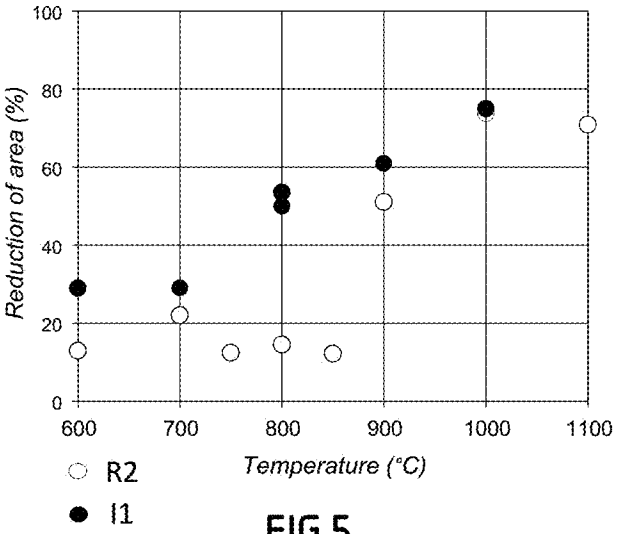
FIG. 5 is a graph illustrating the reduction in area obtained through a tensile test at high temperatures for a steel of the present disclosure and a comparative steel.

The results of these tests, illustrated on FIG. 5, show that the hot ductility of sample I1 remains high even at decreasing temperatures, especially at temperatures comprised between 800° C. and 900° C., whereas the ductility of sample R2 drastically decreases with the temperature.

As a consequence, sample I1 can be processed at lower temperatures than sample R2. Conversely, during the manufacturing process, the occurrence of cracks or bleedings in sample I1 will be largely reduced as compared to sample R2.

The inventors have further characterized the $TiB_2$ precipitates of the as cast products on samples taken from ¼ the thickness from samples I1, R1 and R2, and a sample taken from half the thickness of sample I1 by image analysis using a Scanning Electron Microscope (SEM). The specimens for microscopic examination were prepared using standard metallographic technique for surface preparation and etched with nital reagent.

The size distributions are reported in Table 4 below

As shown in Table 4, sample R1 comprise a high percentage of coarse precipitates, having a surface area higher than 8 $\mu m^2$.

Sample R2 comprises a higher fraction of small $TiB_2$ precipitates than sample R1. However, the percentage of $TiB_2$ precipitates having a surface area lower than 8 $\mu m^2$ for sample R2 does not reach 96%.

By contrast, sample I1 has a very high fraction of $TiB_2$ precipitates with an area of at most 8 $\mu m^2$, especially higher than 96% In addition, the fraction of $TiB_2$ precipitates with an area of at most 3 $\mu m^2$ is higher than 80%, and all the $TiB_2$ precipitates have an area lower than or equal to 25 $\mu m^2$.

TABLE 4

| Sample reference | Percentage of $TiB_2$ with an area of at most 3 $\mu m^2$ | Percentage of $TiB_2$ with an area of at most 8 $\mu m^2$ | Percentage of $TiB_2$ with an area of at most 25 $\mu m^2$ |
|---|---|---|---|
| I1 | 83.9 | 96.7 | 100 |
| R1 | 46.6 | 70.3 | 86.7 |
| R2 | 81.2 | 94.5 | 98.5 |

In Table 4, the underlined values are not according to the present disclosure.

Besides, after solidification, sample I1 was heated to a temperature of 1200° C., then hot-rolled with a final rolling temperature of 920° C., to produce a hot-rolled sheet having a thickness of 2.4 mm.

The hot-rolled steel sheet I1 was further cold-rolled with a reduction ratio of 40% to obtain a cold-rolled sheet having a thickness of 1.4 mm.

After cold-rolling, the steel sheet I1 was heated with an average heating rate of 3° C./s to an annealing temperature of 800° C. and held at this temperature for 60 s.

After solidification, samples R1 and R2 were cooled to room temperature, then reheated to a temperature of 1150° C. and hot-rolled with a final rolling temperature of 920° C. to produce a hot-rolled sheet having a thickness of 2.2 mm and 2.8 mm respectively.

The microstructures of the hot-rolled sheets produced from samples I1, R1 and R2 were investigated by collecting samples at locations situated at ¼ the thickness of the sheets and at half the thickness of the sheets, so as to observe the structure along longitudinal plane at half distance between the core and the surface of the sheets and at the core of the sheets respectively.

The microstructures were observed with a Scanning Electron Microscope (SEM) after etching with the Klemm reagent.

Figure 6:
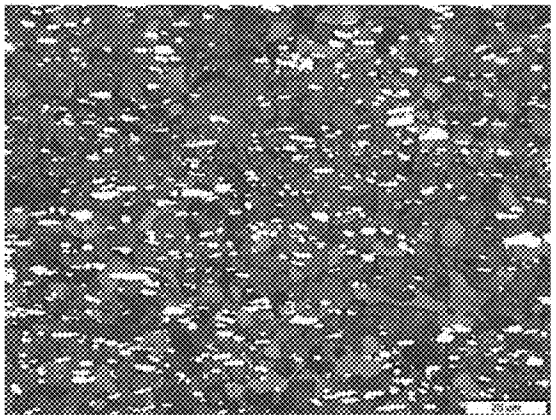
FIG. 6 is a micrograph illustrating the structure of a steel sheet according to the present disclosure, along a longitudinal plane located at ¼ of the thickness of the steel sheet.
Figure 7:
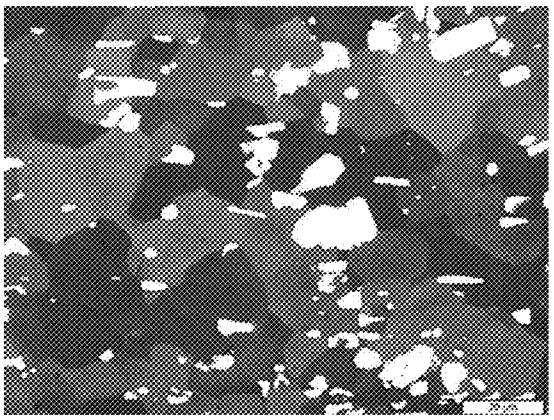
FIGS. 7 and 8 are micrographs illustrating the structure of comparative steel sheets, along a longitudinal plane located at ¼ of the thickness of the steel sheets.
Figure 8:
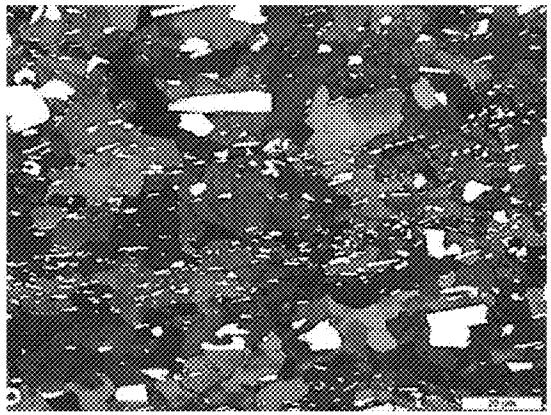

The microstructure of steels I1, R1 and R2 at ¼ of the thickness are shown on FIGS. 6, 7 and 8 respectively.

Figure 9:
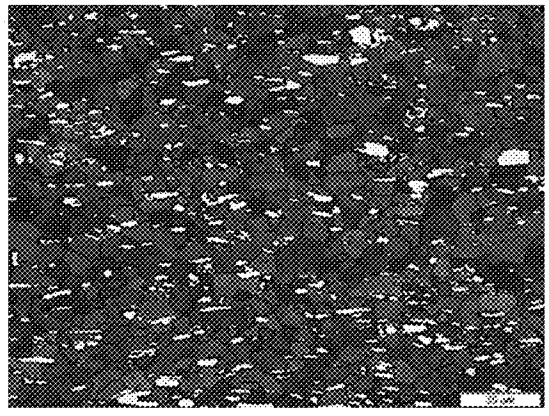
FIG. 9 is a micrograph illustrating the structure of the steel sheet of FIG. 6, along a longitudinal plane located at half the thickness of the steel sheet.
Figure 10:
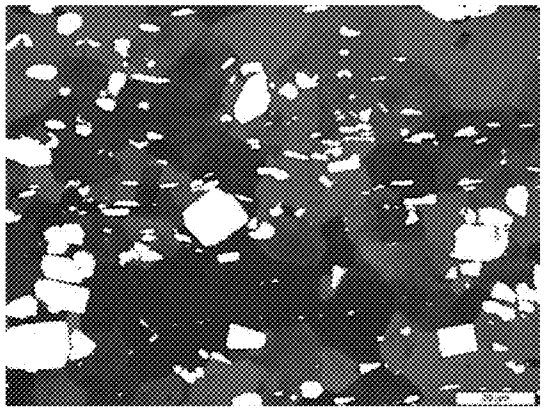
FIGS. 10 and 11 are micrographs illustrating the structure of the comparative steel sheets of FIGS. 7 and 8, along a longitudinal plane located at half the thickness of the steel sheets.
Figure 11:
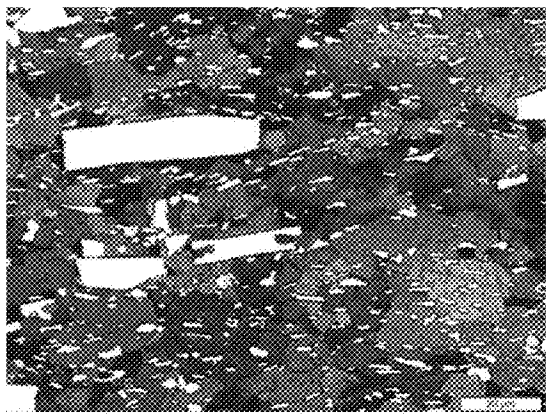

The microstructure of steel sheets I1, R1 and R2 at half the thickness are shown on FIGS. 9, 10 and 11 respectively.

These figures show that the structure of steel I1 is very fine, both at ¼ thickness and at the core of the product.

By contrast the structure of steel R1, which was cooled with lower solidification rates, comprises coarse grains.

The structure of steel R2, though comprising fine grains at ¼ thickness, also comprises coarse grains, especially at the core of the semi-product.

Overall, the structure of steel I1 is very homogeneous, whereas the structures of steels R1 and R2 each comprise grains with very different sizes.

The inventors have further investigated the cold formability of steels I1, R1 and R2.

The cold formability of the steels was assessed on steels sheets produced from as cast steels I1, R1 and R2 with plane strain tests.

Especially, samples were collected from the sheets made of steels I1, R1 and R2, and the forming limit curves for steels I1, R1 and R2 were determined. These forming limit curves are illustrated on FIG. 12, and the measurements reported in Table 5 below.

Figure 12:
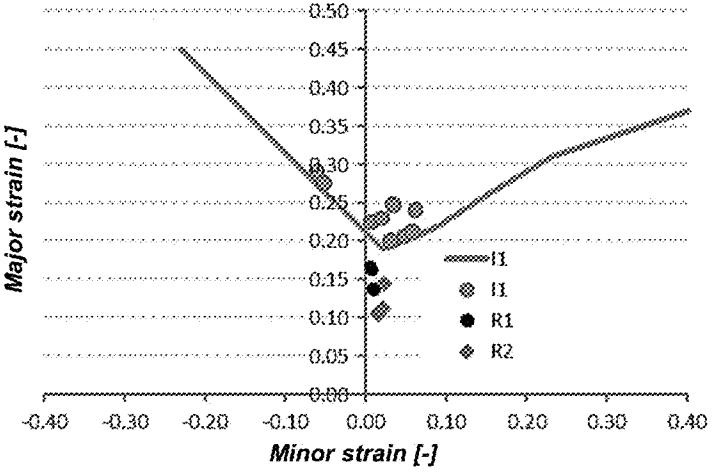
FIG. 12 illustrates the forming limit curves for the steel sheets of FIGS. 6-11, FIGS. 13 and 14 are micrographs illustrating the damages of the steel sheet of FIGS. 7 and 10 after cold-rolling, along a longitudinal plane located at the surface of the cold-rolled steel sheet and along a longitudinal plane located at half the thickness of the cold-rolled steel sheet respectively.

As shown by FIG. 12 and Table 5, steel I1 has an improved formability as compared to steels R1 and R2.

Without being bound to a theory, it is thought that the presence of coarse $TiB_2$ precipitates in steels R1 and R2, even in a small quantity, promotes localization of the strain during the forming operations, in the present case during the bending, which leads to a poorer formability than steel I1. It is further thought that the localization may result from the early damage of the coarse $TiB_2$ precipitates colliding.

By contrast, steel I1 comprise no coarse precipitates, which minimizes the collision of the $TiB_2$ precipitates and therefore improves the formability.

TABLE 5

| Steel | $\varepsilon_2$ | $\varepsilon_1$ |
|---|---|---|
| I1 | −0.061 | 0.292 |
| | −0.052 | 0.275 |
| | 0.007 | 0.224 |
| | 0.02 | 0.229 |
| | 0.031 | 0.2 |
| | 0.034 | 0.247 |
| | 0.047 | 0.205 |
| | 0.058 | 0.212 |
| | 0.062 | 0.24 |
| R1 | 0.00718 | 0.165 |
| | 0.00821 | 0.161 |
| | 0.0103 | 0.136 |
| R2 | 0.016 | 0.104 |
| | 0.017 | 0.107 |
| | 0.021 | 0.111 |
| | 0.023 | 0.144 |

To confirm the influence of the size of the $TiB_2$ precipitates on the formability, the inventors subjected a hot-rolled steel sheet R1, obtained through the process disclosed above, to cold-rolling, with a cold reduction ratio of 50%. After cold-rolling, the steel sheet R1 was heated with an average heating rate of 3° C./s to an annealing temperature of 800° C. and held at this temperature for 60 s.

The inventors then collected specimens from the surface and from the core of the cold-rolled steel sheet R1 (after annealing), and observed these specimens by Scanning Electron Microscopy.

Figure 13:
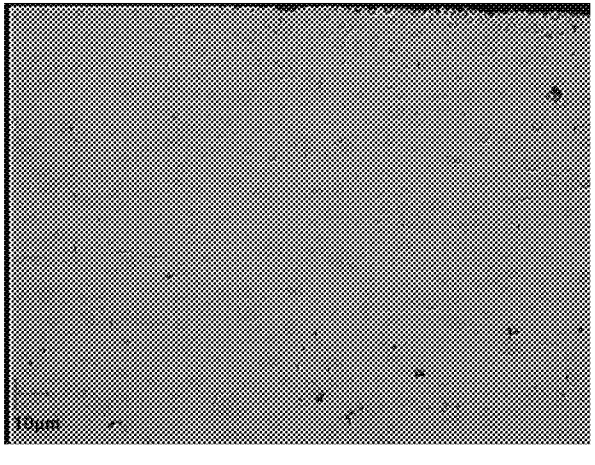
Figure 14:
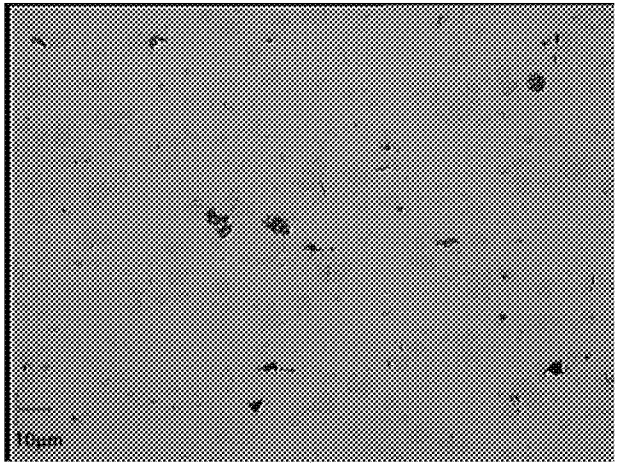

The structures observed at the surface and at the core are illustrated on FIGS. 13 and 14 respectively.

As visible on these figures, the specimen collected from the surface of the sheet comprises few damages, unlike the specimen collected form the core, in which an important damaging is observed.

These observations confirm that the coarse $TiB_2$ precipitates, which are mainly located at the core of the sheet owing to the lower solidification rate in this portion, cause damage during deformation and therefore degrade the formability of the steel.

The bending ability of steels I1, R1 and R2 was assessed by performing an edge bending test (also named 90° flanging test) on samples collected from the hot-rolled steel sheets made of steels I1, R1 and R2, and from the cold-rolled steel sheet (after annealing) made of steel I1.

The samples were held between a pressure pad and a die, and a sliding die was slid to bend the portion of the sample protruding from the pad and the die. The bending test was performed in the rolling direction (RD) and in the transverse direction (TD), according to the standard EN ISO 7438: 2005.

The bending ability was characterized by the ratio R/t between the radius of curvature R of the bent sheet (in mm) and the thickness t of the sample (in mm).

The results as summarized in Table 6 below.

TABLE 6

| Sample | t (mm) | R/t (RD) | R/t (TD) |
|---|---|---|---|
| I1 | 2.4 | 0.8 | 0.3 |
| I1 | 1.4 | 0.4 | 0.3 |
| R1 | 2.2 | 2.7 | 2.7 |
| R2 | 2.8 | 2.1 | 1.4 |

In this table, t designates the thickness of the sample, and R/t designates the measured ratio between the radius of curvature of the bent sheet and the thickness.

These results demonstrate that the steel according to the present disclosure has an improved bending ability as compared to steels R1 and R2.

The Charpy energy of steels I1 and R2 was further determined on samples collected from the hot-rolled sheets, at temperatures ranging from −80° C. to 20° C.

Especially, sub-size Charpy impact specimen (10 mm×55 mm×thickness of the sheet) with V notches 2 mm deep, with an angle of 45° and 0.25 mm root radius were collected from hot-rolled steel sheets made of steels I1 and R2.

At each temperature, the surface density Kcv of impact energy was measured. At each temperature, the test was performed on two samples, and the average value of the two tests calculated.

The results are illustrated on FIG. 15, and reported in Table 7 below.

In this table, T designates the temperature in degrees Celsius and Kcv designates the surface density of impact energy in $J/cm^2$. In addition, the fracture mode (ductile fracture, mixed mode of ductile and brittle fracture or brittle fracture) is reported.

Figure 15:
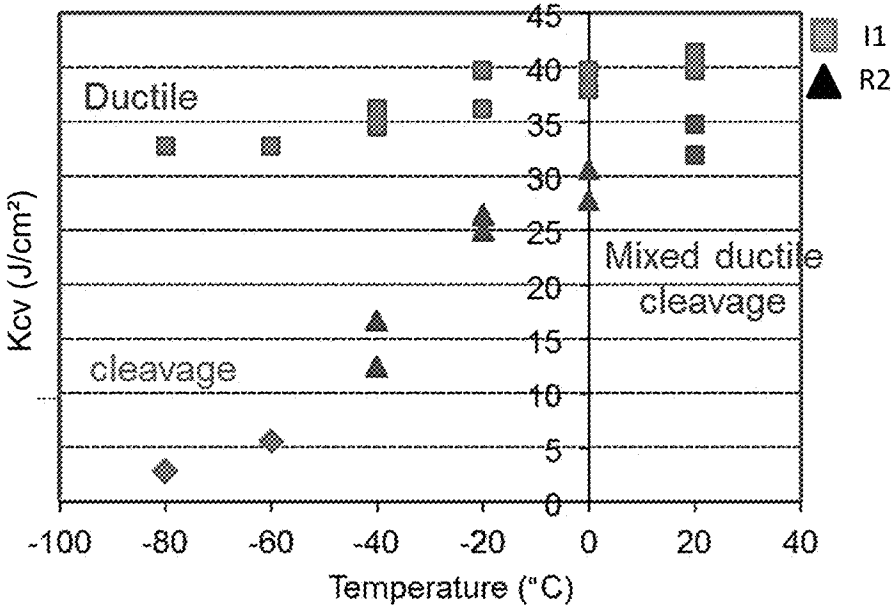
FIG. 15 is a graph illustrating the Charpy energy Kcv of the steel sheet of FIGS. 6 and 9 and of the steel sheet of FIGS. 8 and 11.

As shown in Table 7 and FIG. 15, the Charpy energy of steel I1 of the present disclosure is much higher than the Charpy energy of steel R2. Moreover, the transition temperature from ductile to mixed fracture mode for steel I1 is lowered as compared to steel R2. Especially, in the steel of the present disclosure, the fracture remains 100% ductile at −20° C.

TABLE 7

| | Steel I1 (thickness = 1.45 mm) | | Steel R2 (thickness = 1.8 mm) | |
|---|---|---|---|---|
| T (° C.) | Kcv (J/cm$^2$) | Fracture mode | Kcv (J/cm$^2$) | Fracture mode |
| −80 | 33 | mixed | 3 | brittle |
| −60 | 33 | mixed | 6 | brittle |
| −40 | 35 | mixed | 15 | mixed |
| −20 | 38 | ductile | 25 | mixed |
| 0 | 39 | ductile | 29 | mixed |
| 20 | 41 | ductile | 33 | ductile |

These tests therefore demonstrate that the steel of the present disclosure as an improved formability, ductility and toughness as compared to:

steel R1, which has a Ti* content higher than 0.95% but was not cast under the form a thin product, and thus having TiC and coarse $TiB_2$ precipitates, steel R2, which was cast in the form of a thin product but has a Ti* content lower than 0.95%, and thus having TiC and comprising may $TiB_2$ precipitates with a surface area higher than 8 μm$^2$.

Finally, the mechanical properties of steels sheets I1, R1 and R2 were determined. Table 8 below reports the yield strength YS, the tensile strength TS, the uniform elongation UE, the total elongation TE and the elasticity modulus in tension E, the work hardening coefficient n and the Lankford coefficient r. Table 8 also reports the volumic percentage of $TiB_2$ ($f_{TiB2}$) precipitates for each steel.

TABLE 8

| Sample | YS (MPa) | TS (MPa) | UE (%) | TE (%) | n | r | $f_{TiB2}$ (%) | E (GPa) |
|---|---|---|---|---|---|---|---|---|
| I1 | 300 | 653 | 15.4 | 23.3 | 0.214 | 0.7 | 9 | 232 |
| R1 | 245 | 530 | 14.2 | 19.7 | 0.192 | 0.8 | 12 | 240 |
| R2 | 291 | 567 | 15.2 | 20.8 | 0.2 | 0.7 | 10.9 | 240 |

These results demonstrate that the mechanical properties of steel I1 are improved as compared to the mechanical properties of steels R1 and R2. This improvement is in particular due to the high proportion of very small size precipitates in steel I1, as compared to steels R1 and R2.

The present disclosure therefore provides a steel sheet and a manufacturing method thereof having at the same time a high elasticity modulus in tension, a low density, and improved castability and formability. The steel sheet of the present disclosure can therefore be sued to produce parts with complex shapes, without inducing damages or surface defects.

What is claimed is:

1. A process for manufacturing a steel sheet, the process comprising the following successive steps:

providing a steel having a composition comprising, by weight percent:

0.010%≤C≤0.080%, 0.06%≤Mn≤3%,

Si≤1.5%, 0.005%≤Al≤1.5%,

S≤0.030%,

P≤0.040%,

Ti and B such that:

3.2%≤Ti≤7.5%, (0.45×Ti)−1.35≤B≤(0.45×Ti)−0.43, and optionally one or more elements chosen amongst:

Ni≤1%,

Mo≤1%,

Cr≤3%,

Nb≤0.1%,

V≤0.1%, and a remainder being iron and unavoidable impurities; and casting the steel to form a semi-product, with a casting temperature lower than or equal to $L_{liquidus}$+40° C., $L_{liquidus}$ designating a liquidus temperature of the steel, the semi-product being cast in a form of a thin semi-product having a thickness of at most 110 mm, the steel being solidified during the casting with a solidification rate comprised between 0.03 cm/s and 5 cm/s at every location of the semi-product.

2. The process according to claim 1, wherein the semi-product is cast in a form of a thin slab having a thickness lower than or equal to 110 mm.

3. The process according to claim 1, wherein the semi-product is cast in a form of a thin slab having a thickness lower than or equal to 70 mm.

4. The process according to claim 2, wherein the semi-product is cast by compact strip production.

5. The process according to claim 1, wherein the semi-product is cast in a form of a thin strip having a thickness lower than or equal to 6 mm, the solidification rate being comprised between 0.2 cm/s and 5 cm/s at every location of the semi-product.

6. The process according to claim 5, wherein the semi-product is cast by direct strip casting between counter-rotating rolls.

7. The process according to claim 1, further comprising, after casting and solidification, hot-rolling the semi-product, to obtain a hot-rolled steel sheet.

8. The process according to claim 7, wherein between casting and hot-rolling, a temperature of the semi-product remains higher than 700° C.

9. The process according to claim 7, further comprising before the hot-rolling, de-scaling the semi-product at a temperature of at least 1050° C.

10. The process according to claim 7, further comprising after the hot-rolling, cold-rolling the hot-rolled steel sheet, to obtain a cold-rolled steel sheet having a thickness lower than or equal to 2 mm.

11. The process according to claim 1, wherein the titanium, boron and manganese contents are such that:

$$(0.45\times Ti)-1.35\leq B\leq(0.45\times Ti)-0.43$$

$$\text{and } (0.45\times Ti)-1.35\leq B\leq(0.45\times Ti)-(0.261\times Mn)-0.414.$$

12. The process according to claim 1, wherein the titanium and boron contents are such that:

$$(0.45\times Ti)-1.35\leq B\leq(0.45\times Ti)-0.50.$$

13. The process according to claim 1, wherein the composition is such that 0.010%≤C≤0.050%.

14. The process according to claim 1, wherein the composition is such that 0.005%≤Al≤1.3%.

15. The process according to claim 1, wherein the steel sheet has a structure consisting of ferrite, at most 10% of austenite, and precipitates, said precipitates comprising eutectic precipitates of $TiB_2$, a volume fraction of $TiB_2$ precipitates with respect to the whole structure being at least 9%, a percentage of $TiB_2$ precipitates having a surface area lower than 8 $\mu m^2$ being at least 96%.

16. The process according to claim 15, wherein a percentage of $TiB_2$ precipitates having a surface area lower than 3 $\mu m^2$ is at least 80%.

17. The process according to claim 15, wherein a percentage of $TiB_2$ precipitates having a surface area lower than 25 $\mu m^2$ is 100%.

18. The process according to claim 15, wherein in a core region of the steel sheet, a percentage of $TiB_2$ precipitates having a surface area lower than 8 $\mu m^2$ is at least 96%.

19. The process according to claim 15, wherein said steel sheet comprises TiC precipitates with a volume fraction of 0.5% or lower with respect to the whole structure.

20. The process according to claim 15, wherein the steel sheet comprises no $Fe_2B$ precipitates.

21. The process according to claim 1, wherein the steel sheet has a Charpy energy Kcv of at least 25 $J/cm^2$ at −40° C.

22. The process according to claim 1, wherein the steel sheet has a content, by weight percent, of free Ti of at least 0.95% and less than 3%.

* * * * *